US008025589B2

(12) United States Patent
Brinton et al.

(10) Patent No.: US 8,025,589 B2
(45) Date of Patent: Sep. 27, 2011

(54) SET OF GOLF CLUBS AND METHOD FOR IDENTIFICATION OF CLUBS

(75) Inventors: Marshall K. Brinton, Spicer, MN (US); Daniel M. Mohs, Spicer, MN (US); Paul A. Vossen, Spicer, MN (US)

(73) Assignee: Marshall Kim Brinton, Willmar, MN (US)

( * ) Notice: Subject to any disclaimer, the term of this patent is extended or adjusted under 35 U.S.C. 154(b) by 1466 days.

(21) Appl. No.: 09/952,365

(22) Filed: Sep. 11, 2001

(65) Prior Publication Data

US 2005/0282652 A1 Dec. 22, 2005

(51) Int. Cl.
*A63B 53/00* (2006.01)

(52) U.S. Cl. ..... 473/290; 473/324; 473/316

(58) Field of Classification Search ..... 40/625, 40/630; 473/324, 316, 290
See application file for complete search history.

(56) References Cited

U.S. PATENT DOCUMENTS

| | | | | | |
|---|---|---|---|---|---|
| 1,914,781 | A * | 6/1933 | Mattern, Jr. et al. | ..... | 40/631 |
| 2,088,412 | A * | 7/1937 | Grosvenor | ..... | 40/326 |
| 2,361,415 | A * | 10/1944 | Reach | ..... | 473/309 |
| 2,879,819 | A * | 3/1959 | Turnbull | ..... | 206/315.4 |
| 3,580,582 | A * | 5/1971 | Calamvotsakis | ..... | 273/139 |
| 3,977,679 | A * | 8/1976 | Magiera | ..... | 273/249 |
| 4,123,055 | A * | 10/1978 | Brill | ..... | 473/204 |
| 4,679,791 | A * | 7/1987 | Hull | ..... | 473/201 |
| 5,312,105 | A * | 5/1994 | Cleveland | ..... | 473/350 |
| 5,478,082 | A * | 12/1995 | De Knight et al. | ..... | 473/218 |
| 6,017,281 | A * | 1/2000 | Behling | ..... | 473/330 |
| 6,093,112 | A * | 7/2000 | Peters et al. | ..... | 473/291 |
| 6,196,936 | B1 * | 3/2001 | Meckel | ..... | 473/349 |
| 6,341,690 | B1 * | 1/2002 | Swiatosz | ..... | 206/315.6 |
| 6,425,831 | B1 * | 7/2002 | Heene et al. | ..... | 473/332 |

FOREIGN PATENT DOCUMENTS

| | | | |
|---|---|---|---|
| EP | 0 953 368 | A1 * | 4/1996 |
| JP | 11206936 | A * | 8/1999 |

* cited by examiner

*Primary Examiner* — Stephen L. Blau
(74) *Attorney, Agent, or Firm* — Nelson R. Capes; Briggs and Morgan, P.A.

(57) ABSTRACT

A sport set (10) and methods for golf club identification are provided. The sports set (10) includes a plurality of clubs (10 and 12) with each club (10 or 12) or subset of the plurality of clubs (10 or 12) provided with a distinguishing surface configuration on at least a portion of the exterior surface of head (18) to enable a golfer to visually distinguish between each club (10 or 12) or between subsets of clubs (10 or 12).

4 Claims, 4 Drawing Sheets

SET OF GOLF CLUBS AND METHOD FOR IDENTIFICATION OF CLUBS

BACKGROUND OF THE INVENTION

1. Field of the Invention

The present invention relates to the game of golf and, more particularly, to configurations and methods to distinguish between golf clubs in a set of golf clubs.

2. Description of the Related Art

Mastering the game of golf is an endless pursuit for millions of people around the world. To master the game, one must not only conquer the physical aspects of the game but must also conquer the mental aspect of the game. One important step in mastering the mental aspect of the game is to identify the appropriate shot to play from a particular distance given the ball's particular lie with, of course, consideration given to the layout of the golf course. A wide variety of golf shots are available. The golfer may choose from a full swing, a flop shot, a lob shot, a chip shot, a sand shot, a pitch shot, a punch shot or other shot that may be available in that golfer's arsenal. Each shot confers various advantages given the lie of the ball and will also determine the speed and trajectory of the ball as it leaves the face of the club head. Thus, the shot chosen will depend on many factors, including: the distance to the pin; the existence of any obstructions such as tree limbs; the environmental conditions, most notably wind velocity; and the lie of the ball, most notably whether the ball is in the sand or on the rough, fairway, fringe or green and whether the ball is on a flat or an angled surface. However, the calculus does not end with the selection of the shot to be used, the golfer must also identify the appropriate club that he or she has available to execute the chosen shot. If the golfer chooses his or her club properly and executes the shot correctly, the ball will take the desired course which typically avoids obstacles and sends the ball in the general direction of the pin.

Unfortunately, proper club identification does not always result in proper club selection. Golfers carry a wide variety of clubs in their bags. If the golfer plays by the rules, the golfer will have no more than 14 clubs in his bag. Ideally, the particular clubs carried by any given golfer are selected to best suit the attributes of that particular golfer's game. The clubs selected by most golfers include a driver, one or more fairway woods, nine or more irons and a putter. From these clubs, the golfer identifies what that golfer feels is his or her strongest club for a particular shot. The bags holding the clubs are generally designed to be relatively compact so that they may be carried by the golfer and are typically configured to receive the handle and shaft of a club leaving the head exposed for club identification. Due to the generally compact design of golf bags and the relatively large number of clubs to be carried, the club heads are generally crowded together and tend to overlap one another. This crowding and overlapping can make the selection of a particular club difficult and frustrating. During the course of a round, a scratch golfer will identify and select an average of seventy two clubs. This results in seventy two opportunities to identify or select the wrong club from one's bag. Although a misidentification of a club for a particular golf shot should be correctable through practice and lessons, the erroneous selection of a club when the proper club had been identified only frustrates the golfer, increasing his or her score and typically facilitating the breakdown of his or her mental game. Thus, the golfer's enjoyment of the game is reduced. Therefore, a need exists for a set of clubs that enables a golfer to more easily and consistently select an identified club.

The similarity in appearance between the various clubs makes the club selection even more difficult. There are only subtle structural differences among the various woods (including the driver) and among the various irons. The differences include slight differences in the size and shape of the club heads as well as differences in the lengths of each club's shaft. However, as noted above, the golf bag receives the shaft (and grip) of each golf club. Thus, only the head of each golf club is typically extending from a golf bag when a club is selected for a shot. This orientation of the clubs in the bag eliminates the shaft length as a distinguishing factor for the golfer and leaves only the subtle differences in the club heads to facilitate identification. Further, the club heads extend from the golf bag at various angles further distorting their appearance and obscuring the various visual clues that aid a golfer in selecting between clubs. Further with a primary difference between the shapes of clubs being their loft, the various angles at which the club heads sit within the bag make proper identification based on the loft of a club almost impossible. Therefore, a need exists for a set of clubs that can be distinguished from one another based on more than just club head size and shape.

Various apparatus and methods have evolved to allow golfers to properly identify the desired club. However, these systems typically require a golfer to identify a number stamped or molded on the sole of the club or to identify a number on a club head cover. In addition, other more technically complicated systems allow the push button identification and mechanical extension of the identified club head above the other clubs in a users bag to aid in selection. However, these apparatus and methods have particular drawbacks.

Generally, golf clubs are identified by numbers or letters stamped or molded into the sole plate of the club head. The numbers and letters are generally recessed into the sole to prevent them from wearing off over time. The numbers' placement typically allows the club to be identified when the club is inverted, such as the club would be when the club was placed in a golf bag. However, due to the nature of various numerals in addition to the "P" and "S" frequently used on pitching wedges and sand wedges, respectively, there can be some confusion as to the club identified by the number or letter. Particularly, the 6 and 9 irons, and the pitching wedge are easily confused. Similarly, the 2 and 5 irons, and the sand wedge are also easily confused. In addition, the 3 and 8 irons can easily be confused by a golfer. Furthermore, as the clubs typically rest in a golf bag, the club heads frequently overlap. This overlap tends to obscure the numbering and lettering on the soles of the club heads. Thus, a golfer attempting to select an identified club must fumble through the club heads to find and select the identified club. Aside from the frustration of having to search for the club, the golfers fumbling about brings the club heads into contact with one another resulting in excess wear to the club heads from the repeated searches. Therefore, a need exists for a set of clubs and method for club differentiation that does not solely rely on numbering or lettering for proper club selection.

In addition to the confusion between numbers and letters on the sole of the golf clubs, the numbers and letters can affect the swing of a club. As noted above, the numbers or letters are typically stamped or molded into the sole of the club head. That is, the numbers and letters are recessed into the sole of the club head. When the club is swung and the sole contacts the ground, there are necessarily variations in the resistance to the movement of the club along the ground in the golfer's swing plane. These differences in resistance can cause variations in the same swing with the different numbering and lettering on the clubs, thereby reducing a golfers consistency.

Thus, a need exists for a method of club identification that does not necessarily require the stamping or molding of numbers and/or letters into the sole of a club head to eliminate the variation in resistance between clubs as their soles contact the ground.

Further, the nature of golf is that it is typically played outside on natural turf and other natural groundcovers that tend to bring the sole of the club head into contact with dirt and other debris. Ideally, the dirt is cleaned from the club head after every shot. However, typically dirt is compacted into the recessed numbering and/or lettering on the soles of the club heads. This obscures the numbering and/or lettering making it more difficult to properly distinguish the clubs from one another and thus, more difficult to select the proper club. Therefore, a need exists for a set of clubs and method for club differentiation that is not compromised when the sole of the club is dirty.

Another apparatus and method for identifying the proper golf club are designations on club head covers. Frequently, club head covers are provided to protect the finish and allow for identification and selection of clubs. However, head covers can be cumbersome. They are frequently difficult to remove from the club head and to replace over the club head frustrating the golfer and increasing the amount of time required to finish the round. In addition, the club head covers can be placed on the wrong club causing the player to select the improper club. Further, club head covers may be left on an earlier hole and are frequently lost during the course of a round as the player forgets to replace the head cover after a shot, again frustrating the golfer. Therefore, a need exists for a set of clubs and method for club differentiation that does not add to the equipment that must be carried around the course and that can not be separated from the club head so that it may be forgotten at a hole or lost.

Yet another apparatus and method for selecting the proper club are electronic club dispensers. These club dispensers are typically integral with the golf bag and in some cases provide a touch pad to extend a club for selection. That is, once a club is identified on the touch pad, the club is mechanically raised above the other clubs to allow for simplified selection. Although this system simplifies the selection of the clubs, it typically requires that a club be replaced at a particular location within the bag. This placement requires a degree of concentration that a golfer would likely not want to dedicate to placing a golf club within a golf bag and misplacement of a club results in the wrong club being presented for subsequent selection. In addition, such golf bags are complicated and expensive to manufacture. Their complicated nature invites component failure decreasing golfer satisfaction with both the equipment and game. In addition, golf bags with electronic club dispensers tend to be heavier than standard bags. This extra-weight is extremely undesirable especially to golfers who carry their clubs or use a pull cart to transport their clubs around the course. Therefore, a need exists for a set of clubs and method for club differentiation that is not complicated or expensive to manufacture and that does not add to the weight of the equipment that a golfer must transport around the course.

SUMMARY OF THE INVENTION

The present invention meets the above needs and provides additional improvements and advantages that will be recognized by those skilled in the art upon their review of the following specification and figures. The present invention provides a sports set including a plurality of golf clubs with each club or subsets of clubs having a distinct surface configuration to allow a user to distinguish between the clubs or subsets of clubs. The sports set may include at least one wood and at least one iron, may include at least two woods, or may include at least two irons. In a preferred aspect, the sports set includes at least nine irons. In another preferred aspect, the sports set of irons is broken down into a first subset including long irons, a second subset including the middle irons, and a third subset including the short irons.

Generally, each golf club includes a shaft, a grip, and a head. The grip is secured to a first end of the shaft and the head is secured to a second end of the shaft. The head is divided into separate regions includes including a face, a rear side, a toe, a heel, a sole, and a top. The head as a whole and individually each region includes an outer surface. At least a portion of the outer surface has a surface configuration. The surface configuration is provided to distinguish each golf club from other golf clubs or subset of golf clubs from the other subsets of clubs. The surface configuration may be a distinct color. The surface configuration comprising a distinct color to distinguish the each subset golf club from the other subsets golf clubs in the plurality of golf clubs. In another aspect, the surface configuration of each club within each subset of clubs includes distinct hues or shades of the distinct color for the particular subset.

It is thus an object of the present invention to provide such novel apparatus and methods for differentiating between golf clubs in a set of clubs.

It is further an object of the present invention to provide such novel apparatus and methods which allows the differentiation between golf clubs without solely having to rely on the numbering or lettering on the golf club.

It is further an object of the present invention to provide such novel apparatus and methods for club differentiation that are not compromised when the sole of the clubs are covered with debris.

It is further an object of the present invention to provide such novel apparatus and methods for club differentiation that does not add to the equipment that must be carried around the golf course.

It is further an object of the present invention to provide such novel apparatus and methods for club differentiation that can not be separated from the club head so that it may be forgotten at a hole or otherwise separated from the set of golf clubs.

It is further an object of the present invention to provide such novel apparatus and methods for club differentiation that can be simple to manufacture and maintain.

It is further an object of the present invention to provide such novel apparatus and methods for club differentiation that is inexpensive to manufacture and that does not add to the weight of the equipment that a golfer must transport around the course.

These and other objects, features, and advantages of the present invention will become more readily apparent from the following detailed description of the preferred embodiment of the invention when taken in conjunction with the drawings wherein like reference numerals refer to corresponding parts in the several views.

BRIEF DESCRIPTION OF THE DRAWINGS

The illustrative embodiment may best be described by reference to the accompanying drawings where.

Figure 1A:
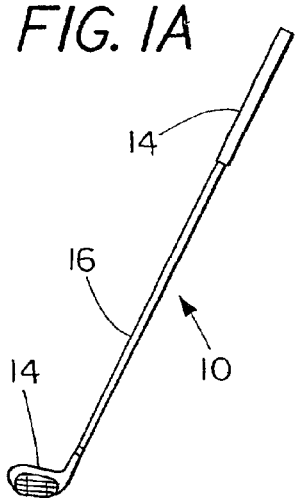
FIG. 1A illustrates a perspective view of an embodiment of a golf club in accordance with the present invention in the form of a wood.

All figures are drawn for ease of explanation of the basic teachings of the present invention only; the extensions of the figures with respect to number, position, relationship and dimensions of the parts to form the preferred embodiment will be explained or will be within the skill of the art after the following description has been read and understood. Further, the exact dimensions and dimensional proportions of a set of golf clubs in accordance with the present invention will likewise be within the skill of the art after the following description has been read and understood.

Where used in various figures of the drawings, the same numerals designate the same or similar parts. Furthermore, when the terms "top," "bottom," "right," "left," "forward," "rear," "first," "second," "inside," "outside," and similar terms are used, the terms should be understood to reference only the structure shown in the drawings as it would appear to a person viewing the drawings and utilized only to facilitate describing the illustrated embodiment.

DETAILED DESCRIPTION OF THE PREFERRED EMBODIMENT

Figure 1B:
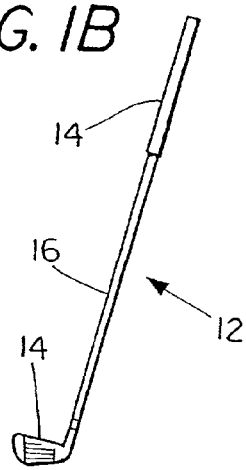
FIG. 1B illustrates a perspective view of an embodiment of a golf club in accordance with the present invention in the form of an iron.

FIGS. 1A and 1B illustrate a wood 10 and an iron 12, respectively, from a set of golf clubs in accordance with the present invention. The following description will reference these clubs individually as wood 10 and iron 12 or jointly as clubs 10 and 11, as appropriate for ease of description. A regulation set of clubs 10 and 11, as determined by the professional golfer's associations, includes fourteen clubs. The set generally includes a plurality of woods 10, nine or more irons, and a putter (not shown). The woods 10 typically carried by a golfer include a driver and one or more fairway woods. The irons 12 carried by a golfer typically include a 3 iron through sand wedge. Other specialized clubs (not shown) that are adapted to assist the golfer in particular situations may also be included in the set of clubs.

Regardless of the club type, golf clubs 10 and 12 are generally configured to permit the golfer to strike a ball by swinging the club. To accomplish this, golf clubs 10 and 12 include a grip 14, a shaft 16 and a head 18. Grip 14 is secured to shaft 16. Grip 14 is placed at a location along shaft 16 to permit a golfer to allow a golfer to swing either of clubs 10 or 12 to strike a golf ball. Typically, grip 14 is positioned adjacent one of the ends of shaft 16. Head 18 is attached to shaft 16, typically at an end opposite of the end on which grip 14 is attached to the shaft. Head 18 is generally configured to strike the ball on a face 20 of head 18. Head 18 is typically formed from one or more metals or alloys of metals, wood, or combinations of wood and metal. The head 18 also includes an outer head surface. The outer head surface comprising the external surface of club head 18. In accordance with the present invention, the outer head surface is provided with a surface configuration 34 that is distinct for each head or for a particular group of heads 18 within the set of golf clubs. Shaft 16 is an elongated structure typically round in cross section that enables a user to transfer force from grip 14 held in a user's hands to head 18 which contacts the golf ball as the club is swung. Thus, shaft 16 is formed from a material having sufficient strength to withstand the forces conferred by a golfer to grip 14 to accelerate club head 18. Shaft 16 is typically formed from a metal, an alloy of a metal or graphite.

Head 18 is generally configured to contact the ball as the golfer swings the club to which head 18 is secured. Structurally, head 18 includes a face 20, a rear side 22, a toe 24, a heel 26, a sole 28, and a top 30, as shown in FIGS. 2A to 5D. Face 20 of the club is, optimally, the portion of club head 18 that strikes the ball as the golfer swings the club. Face 20 typically includes a plurality of grooves 32 to allow better control of the ball by the golfer. The remainder of head 18 is generally shaped and weighted to facilitate accurate and precise ball striking.

In addition, head 18 has a distinct surface configuration 34 visible on the outer surface of head 18. Distinct surface configuration 34 is provided to allow the golfer to distinguish a club or a subset of clubs from the other clubs in his or her set of clubs. Surface configurations 34 shown in FIGS. 2A to 5D are illustrated as distinct colors for exemplary and ease of illustration purposes only. In one aspect of the invention, surface configuration 34 may be a distinct coloration provided on the outer surface of club head 18. The coloration may be any of a variety of colors, shades, hues, tints or other variations in color that enable a golfer to distinguish between surface configurations 34 of different clubs or groups of clubs within a set of clubs. In another aspect of the invention, the surface configuration 34 of the outer head surface may be a distinct pattern or design provided on the outer surface of club head 18. The distinct pattern or design could include cross hatching, herring bone, chevron, polka dot, or other variations in pattern or design that would enable a golfer to distinguish between surface configurations 34. Further, the outer head surface may be subdivided to correspond to each region or component of head 18 wherein only particular regions or components include distinctive surface configuration 34.

Generally, the surface configuration 34 is provided on club head 18 to allow the golfer to identify and select the proper club 10 or 12 from a golf bag containing a plurality of inverted golf clubs 10 and 12. For example, head 18 may be provided with a distinctive surface configuration 34 only on sole 28 of head 18 as illustrated in FIGS. 3A to 3D. In addition or alternatively, surface configuration 34 may be provided on head 18 to allow the golfer to confirm his or her proper club selection as the golfer stands above club 10 or 12 in preparation for striking the ball. For example, head 18 may be provided with a distinctive surface configuration 34 only on top 30 of head 18 as illustrated in FIGS. 4A to 4D. To allow a golfer to identify and select the proper club 10 or 12 from a golf bag containing a plurality of inverted golf clubs 10 and 12 and to confirm his or her proper club selection as the golfer stands above club 10 or 12 in preparation for striking the ball, both sole 28 and top 30 of head 18 may have a distinctive surface configuration 34 or the entire outer surface of head 18 may include a distinctive surface configuration 34.

In one embodiment, the present invention may provide a set of golf clubs with each golf club having a distinct surface configuration 34. This embodiment allows a golfer to distinguish between each club individually based on the surface configuration 34.

In another embodiment, the present invention may provide a set of nine irons 12, for example, divided into subsets, such as for example the subsets of long irons (3 iron to 5 iron), middle irons (6 iron to 8 iron) and short irons (9 iron to sand wedge). In this embodiment, each subset would be provided with a particular surface configuration 34 to distinguish the particular subsets of irons 12 from one another. If a color was used as a surface configuration 34, each iron 12 within the subset could be the same color or each iron 12 or wood 10 in the subset could be different shades or hues of a color to allow a golfer to distinguish between individual clubs within a subset.

The surface configuration 34 of the outer surface may include any surface configuration 34 so long as the surface configuration 34 of each club head in a set of clubs is sufficiently distinct to allow a golfer to distinguish between the clubs based on the surface configuration 34. In one exemplary embodiment, the surface configuration 34 on the outer head surface may comprise one or more layers of paint over the outer head surface. In another exemplary embodiment, the surface configuration 34 on the outer head surface may comprise the outer head surface being anodized with a chosen color. In yet another exemplary embodiment, the surface configuration 34 on the outer head surface may comprise a design or pattern molded, etched, painted or otherwise formed on the outer head surface. Regardless of the particular embodiment, the surface configuration 34 is selected and formed to permit a golfer to distinguish a particular club 10 or 12 from other clubs in the golfer's bag.

Furthermore, each shaft 16 has an outer shaft surface that may also include a surface configuration 34 that may correspond to the surface configuration 34 of the head and that is distinct from the surface configuration 34 of the other shafts in the set of golf clubs to further aid a golfer in distinguishing between the various clubs 10 and 12 in a set of golf clubs.

Figure 2A:
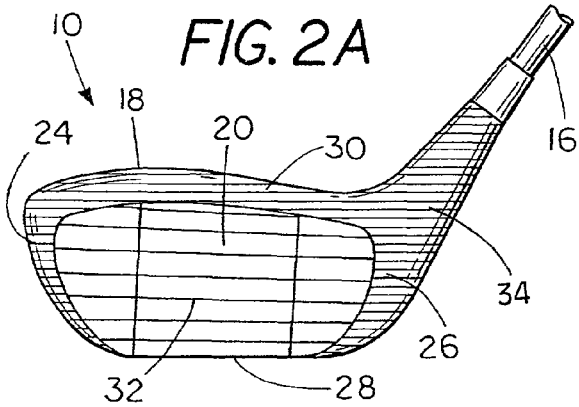
FIG. 2A illustrates a partial perspective view of an embodiment of a golf club in accordance with the present invention in the form of a wood having all of the exterior surface in a first surface configuration except for the face.
Figure 2B:
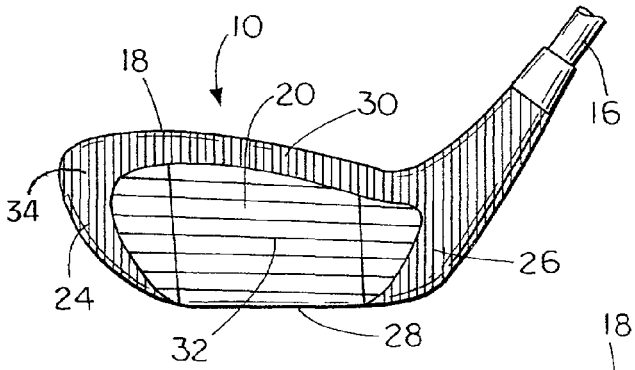
FIG. 2B illustrates a partial perspective view of an embodiment of a golf club in accordance with the present invention in the form of a wood having all of the exterior surface in a second surface configuration except for the face.
Figure 2C:
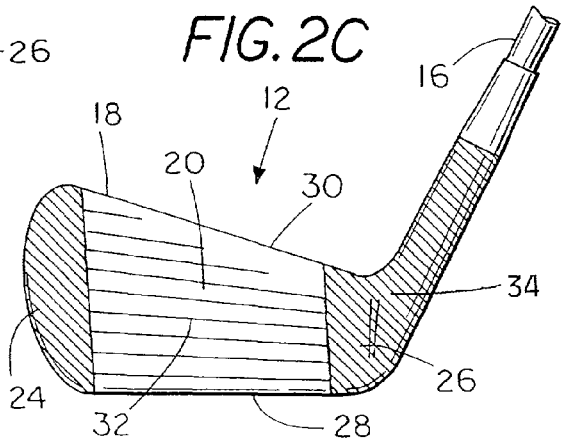
FIG. 2C illustrates a partial perspective view of an embodiment of a golf club in accordance with the present invention in the form of an iron having all of the exterior surface in a third surface configuration except for the face.
Figure 2D:
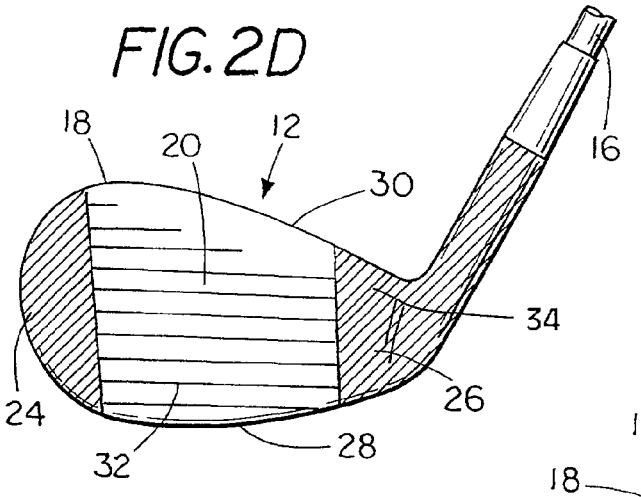
FIG. 2D illustrates a partial perspective view of an embodiment of a golf club in accordance with the present invention in the form of an iron having all of the exterior surface in a fourth surface configuration except for the face.

FIGS. 2A to 2D illustrate one embodiment for a set of clubs in accordance with the present invention. In the embodiment of FIGS. 2A to 2D, the entire outer surface except for face 20 of each club head 18 of clubs 10 and 12 has a surface configuration 34 to distinguish each of the clubs from the other clubs in the set. The wood 10 of FIG. 2A is shown having a surface configuration 34 wherein the outer surface is blue in color. The wood 10 of FIG. 2B is shown having a surface configuration 34 wherein the outer surface is red in color. The iron 12 of FIG. 2C is shown having a surface configuration 34 wherein the outer surface is green in color. The iron 12 of FIG. 2D is shown having a surface configuration 34 wherein the outer surface is brown in color. The surface configuration 34 of each head 18 is illustrated as a different color for exemplary purposes and is in no way intended to limit the variations in surface configurations 34 to distinct colors.

Figure 3A:
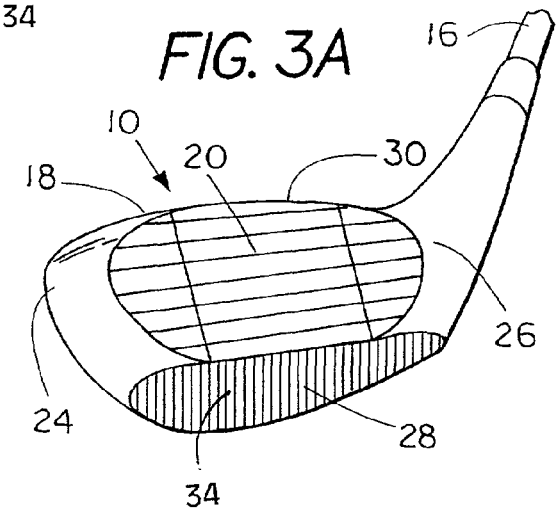
FIG. 3A illustrates a partial perspective view of an embodiment of a golf club in accordance with the present invention in the form of a wood having the exterior surface of the sole of the club head in a first surface configuration.
Figure 3B:
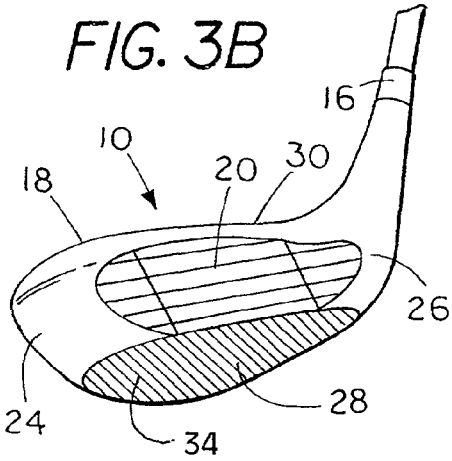
FIG. 3B illustrates a partial perspective view of an embodiment of a golf club in accordance with the present invention in the form of a wood having the exterior surface of the sole of the club head in a second surface configuration.
Figure 3C:
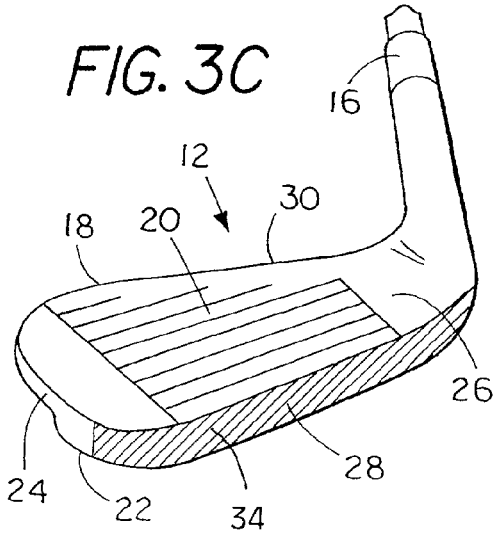
FIG. 3C illustrates a partial perspective view of an embodiment of a golf club in accordance with the present invention in the form of an iron having the exterior surface of the sole of the club head in a third surface configuration.
Figure 3D:
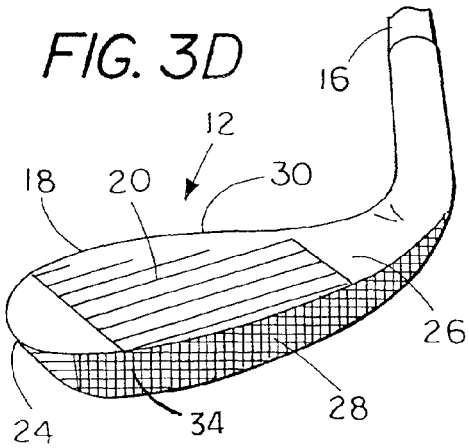
FIG. 3D illustrates a partial perspective view of an embodiment of a golf club in accordance with the present invention in the form of an iron having the exterior surface of the sole of the club head in a fourth surface configuration.

FIGS. 3A to 3D illustrate another embodiment for a set of clubs in accordance with the present invention. In the embodiment of FIGS. 3A to 3D, sole 28 of each club 10 and 12 has a surface configuration 34 to distinguish each club 10 or 12 from other clubs 10 and 12 in the set. The wood 10 of FIG. 3A is shown having a surface configuration 34 wherein the outer surface of sole 28 of head 18 is red in color. The wood 10 of FIG. 3B is shown having a surface configuration 34 wherein the outer surface of sole 28 of head 18 is green in color. The iron 12 of FIG. 3C is shown having a surface configuration 34 wherein the outer surface of sole 28 of head 18 is brown in color. The iron 12 of FIG. 3D is shown having a surface configuration 34 wherein the outer surface of sole 28 of head 18 is yellow in color. Again, the surface configuration 34 of each sole 28 is illustrated as a different color for exemplary purposes and is in no way intended to limit the variations in surface configurations 34 to distinct colors.

Figure 4A:
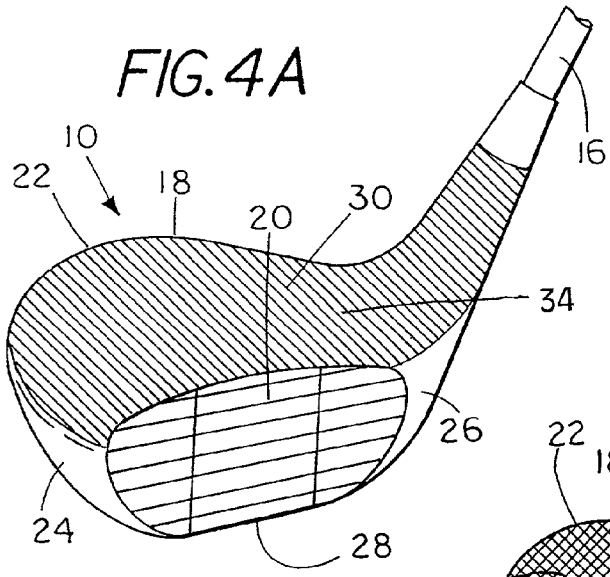
FIG. 4A illustrates a partial perspective view of an embodiment of a golf club in accordance with the present invention in the form of a wood having the exterior surface of the top of the club head in a first surface configuration.
Figure 4B:
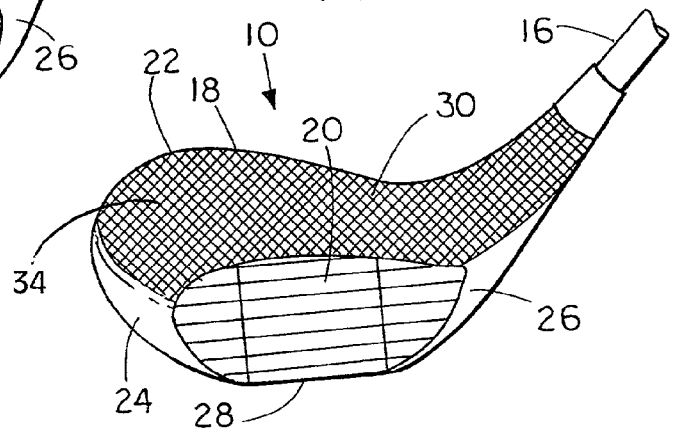
FIG. 4B illustrates a partial perspective view of an embodiment of a golf club in accordance with the present invention in the form of a wood having the exterior surface of the top of the club head in a second surface configuration.
Figure 4C:
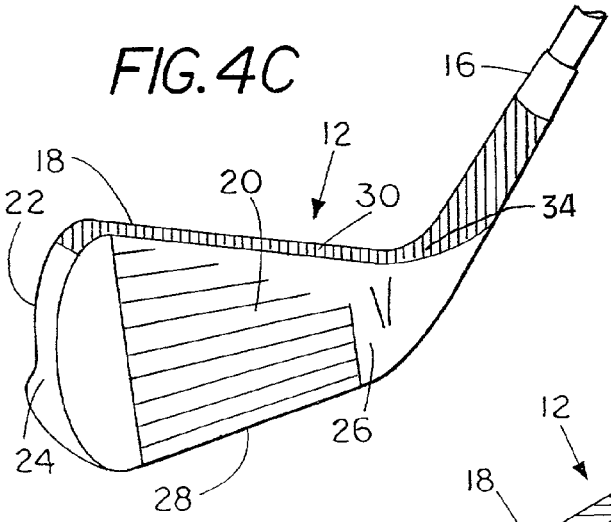
FIG. 4C illustrates a partial perspective view of an embodiment of a golf club in accordance with the present invention in the form of an iron having the exterior surface of the top of the club head in a third surface configuration.
Figure 4D:
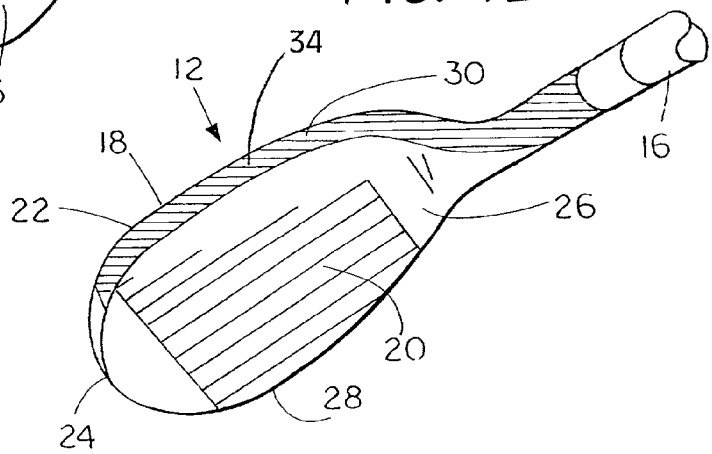
FIG. 4D illustrates a partial perspective view of an embodiment of a golf club in accordance with the present invention in the form of an iron having the exterior surface of the top of the club head in a fourth surface configuration.

FIGS. 4A to 4D illustrate yet another embodiment of a set of clubs in accordance with the present invention. In the embodiment of FIGS. 4A to 4D, the top of each club 10 and 12 has a surface configuration 34 to distinguish each of the clubs from the other clubs in the set. The wood 10 of FIG. 4A is shown having a surface configuration 34 wherein the outer surface of top 30 of head 18 is green in color. The wood 10 of FIG. 4B is shown having a surface configuration 34 wherein the outer surface of top 30 of head 18 is orange in color. The iron 12 of FIG. 4C is shown having a surface configuration 34 wherein the outer surface of top 30 of head 18 is red in color. The iron 12 of FIG. 4D is shown having a surface configuration 34 wherein the outer surface of top 30 of head 18 is blue in color. Again, the surface configuration 34 is illustrated as different colors for exemplary purposes and is in no way intended to limit the variations in surface configurations 34 to distinct colors.

Figure 5A:
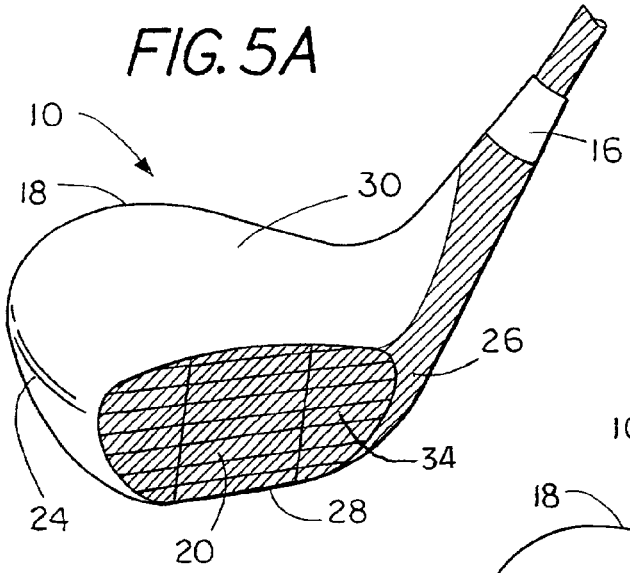
FIG. 5A illustrates a partial perspective view of an embodiment of a golf club in accordance with the present invention in the form of a wood having the exterior surface of the toe, heel, and shaft in a first surface configuration.
Figure 5B:
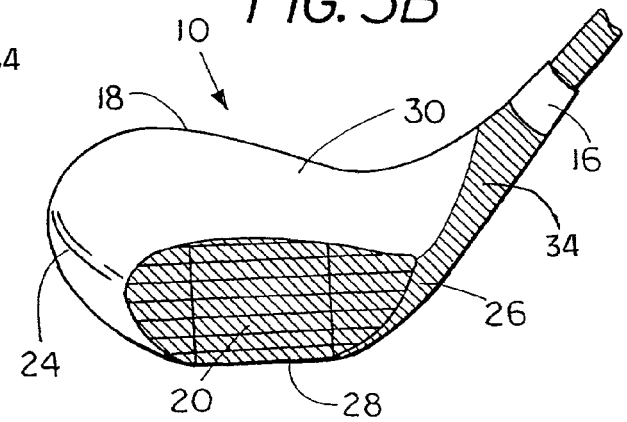
FIG. 5B illustrates a partial perspective view of an embodiment of a golf club in accordance with the present invention in the form of a wood having the exterior surface of the toe, heel, and shaft in a second surface configuration.
Figure 5C:
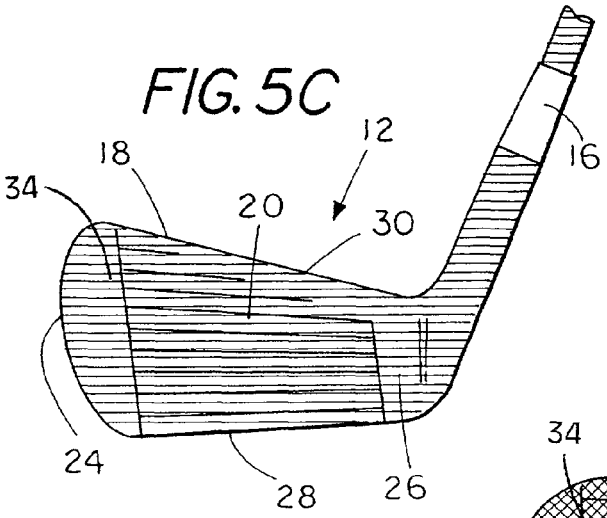
FIG. 5C illustrates a partial perspective view of an embodiment of a golf club in accordance with the present invention in the form of an iron having the exterior surface of the toe, heel, and shaft in a third surface configuration.
Figure 5D:
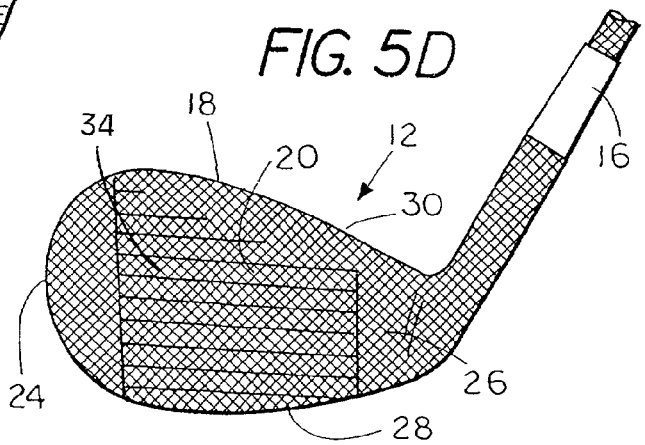
FIG. 5D illustrates a partial perspective view of an embodiment of a golf club in accordance with the present invention in the form of an iron having the exterior surface of the toe, heel, and shaft in a fourth surface configuration.

FIGS. 5A to 5D illustrate still yet another embodiment of a set of clubs in accordance with the present invention. In the embodiment of FIGS. 5A to 5D, the top of each club 10 and 12 has a surface configuration 34 to distinguish each of the clubs from the other clubs in the set. The wood 10 of FIG. 5A is shown having a surface configuration 34 wherein the outer surface of a toe 24 and a heel 26 of head 18, and the outer shaft surface of shaft 16 are brown in color. The wood 10 of FIG. 5B is shown having a surface configuration 34 wherein the outer surface of a toe 24 and a heel 26 of head 18, and the outer shaft surface of shaft 16 are green in color. The iron 12 of FIG. 5C is shown having a surface configuration 34 wherein the outer surface of a toe 24 and a heel 26 of head 18, and the outer shaft surface of shaft 16 are blue in color. The iron 12 of FIG. 5D is shown having a surface configuration 34 wherein the outer surface of a toe 24 and a heel 26 of head 18, and the outer shaft surface of shaft 16 are orange in color. Again, the surface configuration 34 is illustrated as different colors for exemplary purposes and is in no way intended to limit the variations in surface configurations 34 to distinct colors.

The present invention as described-above may be embodied in other specific forms without departing from the spirit or general characteristics of the invention. Only selected representative forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed:

1. A sports set comprising a plurality of golf clubs with each golf club including a shaft, a grip secured to a first end of the shaft, and a head secured to a second end of the shaft and the head further comprising an outer surface said outer surface further comprising a face, a rear side, a toe, a heel, a sole, and a top, a) with a particular region of the outer surface of the head of each golf club having a surface configuration other than the shape of the outer surface of the head to distinguish a subset of the plurality of golf clubs from other subsets in the plurality of golf clubs;

b) wherein said particular region of the outer surface of the head of each golf club is less than the outer surface of the head of each golf club;

c) wherein said distinguishing surface configuration is not a letter or a number;

d) with the surface configuration comprising a distinct color to distinguish the each subset of golf clubs from the other subsets of golf clubs in the plurality of golf clubs; and e) with the surface configuration of each club within each subset of clubs is one of a distinct hue or a distinct shade of the distinct color to the subset to distinguish each club from other clubs within the subset.

2. A sports set, as in claim 1, with the plurality of clubs comprising at least nine irons.

3. A sports set, as in claim 2, further comprising a first subset including long irons, a second subset including the middle irons, and a third subset comprising the short irons.

4. A sports set, as in claim 1, further comprising the plurality of clubs including at least one wood and at least one iron.

* * * * *